United States Patent [19]

Nishikawa

[11] 4,435,901

[45] * Mar. 13, 1984

[54] METHOD OF MANUFACTURING SCISSORS AND SCISSORS

[76] Inventor: Masatoshi Nishikawa, No. 56, Aza-Chira, Sanjoh, Bisai City, Aichi Prefecture, Japan

[ * ] Notice: The portion of the term of this patent subsequent to Feb. 17, 1998 has been disclaimed.

[21] Appl. No.: 223,325

[22] Filed: Jan. 8, 1981

Related U.S. Application Data

[63] Continuation of Ser. No. 29,700, Apr. 3, 1979, Pat. No. 4,250,620.

[30] Foreign Application Priority Data

Nov. 2, 1978 [JP] Japan ..... 53-135352

[51] Int. Cl.[3] ..... B26B 13/02; B21K 11/06

[52] U.S. Cl. ..... 30/254; 76/104 A

[58] Field of Search ..... 30/254, 194, 341, 244, 30/252, 266; 76/104 A; 164/112

[56] References Cited

U.S. PATENT DOCUMENTS

| | | | |
|---|---|---|---|
| 1,609,638 | 12/1926 | Zeidler | 76/104 A |
| 2,377,906 | 6/1945 | Schaaff | 30/349 |
| 2,627,656 | 2/1953 | Richartz | 30/254 |
| 3,750,282 | 8/1973 | Eaton et al. | 30/254 |
| 4,250,620 | 2/1981 | Nishikaw | 30/254 |

FOREIGN PATENT DOCUMENTS

| | | | |
|---|---|---|---|
| 1514169 | 6/1978 | United Kingdom | 30/254 |

*Primary Examiner*—Roscoe V. Parker
*Attorney, Agent, or Firm*—Fred Philpitt

[57] ABSTRACT

Safety scissors wherein the scissor members are composed of a metal member partially embedded in plastic in such a way that a part of the exposed metal serves as a cutting edge and the remaining exposed portion of the metal member bears the sliding friction when the two scissor members are moved relative to each other.

2 Claims, 6 Drawing Figures

METHOD OF MANUFACTURING SCISSORS AND SCISSORS

This is a continuation of application Ser. No. 29,700, filed Apr. 3, 1979 and now U.S. Pat. No. 4,250,620.

BACKGROUND OF THE INVENTION

The present invention relates to a method of manufacturing a scissors comprising blades made of stainless steel plate punched by a press machine and a synthetic resin in which the blade is buried, and to the resulting scissors.

Conventionally used scissors are generally of a type which are made by casting or forging a metal, and such a scissors have flexion characteristic of metal which provides an advantageous point of good cutting quality, but manufacturing cost becomes high and moreover the scissors are not convenient for easy handling due to weight, and are apt to rust easily and polishing by an expert is required to maintain the cutting quality.

On the contrary, scissors made of synthetic resin with a sharp edge metal has been conceived as an ideal type heretofore, but an appropriate flexion at the sharp edge for actual cutting of sheets of paper, or the like is difficult to obtain, and also the sharp edge is apt to separate from the synthetic resin member, and the manufacturing process becomes more complicated, and as a result of the foregoing drawbacks, no one has ever tried to manufacture them in mass production even if there is an economical advantage.

The present invention is intended to eliminate the foregoing various drawbacks.

SUMMARY OF THE INVENTION

An object of the present invention is to provide a scissors made of synthetic resin with a sharp edge made of metal.

Another object of the present invention is to provide a scissors made of synthetic resin with a blade formed with a depressed portion and resin is penetrated into the depressed portion and is hardened so that the blade will never separate from the synthetic resin body.

A further object of the present invention is to provide a scissors wherein a blade is formed with a depressed portion to import an appropriate rigidity, and a moderate curve condition can be provided so that when used for a long period of time, the sharp edge maintains its cutting quality, and even if the curve disappears resulting in the deteriorated cutting quality, the user can improve its cutting quality again by bending the sharp edge with hand.

A still further object of the present invention is to provide a scissors made of synthetic resin wherein a projection is provided near a base end portion in the vicinity of a pivot hole to cause a tight slidable contact of both blades which results in a better cutting quality.

A more specific object of the present invention is to provide a method of manufacturing a scissors made of synthetic resin wherein sharp edges only are made of metal.

A particular object of the present invention is to provide a method of manufacturing a scissors made of synthetic resin wherein a depressed portion is formed on the blade, and the blade is positioned accurately on metal mold for injection molding comprised of a male mold and a female mold, and when the male mold and female mold are closed, the depressed portion formed on the blade is pressurized at a plurality of locations and the sharp edge of the blade is urged against the female mold tightly to prevent the synthetic resin from penetrating into the sharp edge, so that the sharp edge of the blade can be accurately exposed.

Another and more particular object of the present invention is to provide a method of manufacturing a scissors wherein a plurality of through holes are formed on the depressed portion and the synthetic resin is penetrated into the depressed portion and is hardened.

DETAILED DESCRIPTION OF THE INVENTION

Ordinary S-shaped scissors are formed by setting a blade 1 made of metal on a mold for injection molding and pressuring the blade with the male mold toward the female mold, causing the sharp edge of the blade to be in proper contact with the female mold, and injecting synthetic resin into the cavity.

Figure 1:
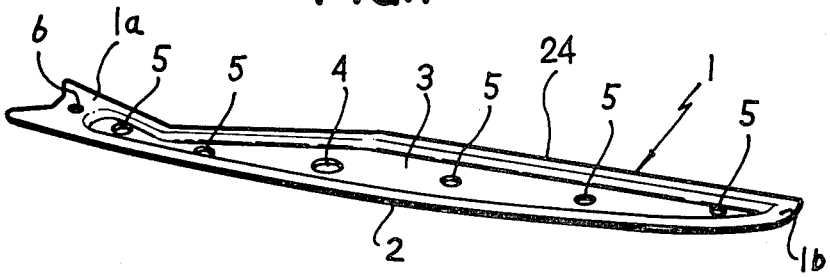
FIG. 1 is a perspective view of a blade.

The inside of the foregoing blade 1 excluding a peripheral edge portion 2 is formed in drawing molding to a depth of about 2 millimeters as shown in FIG. 1 to produce a depressed portion 3. A pivot hole 4 is formed in almost the center of the depressed portion 3 and a plurality of through holes 5, 5 . . . are formed in the depressed portion, and a standard hole 6 for positioning accurately in the metal mold is formed at a position closer to the base end portion 1*a* of the blade 1. The longitudinal portion of the blade 1 is curved slightly with a large radius of curvature to a side (namely, bulged side, in other words, the reverse side of FIG. 1) to the depressed portion 3. This blade 1 can be produced by punching a stainless steel plate of about 0.3 millimeter thick continuously by means of a transfer press.

Figure 2A:
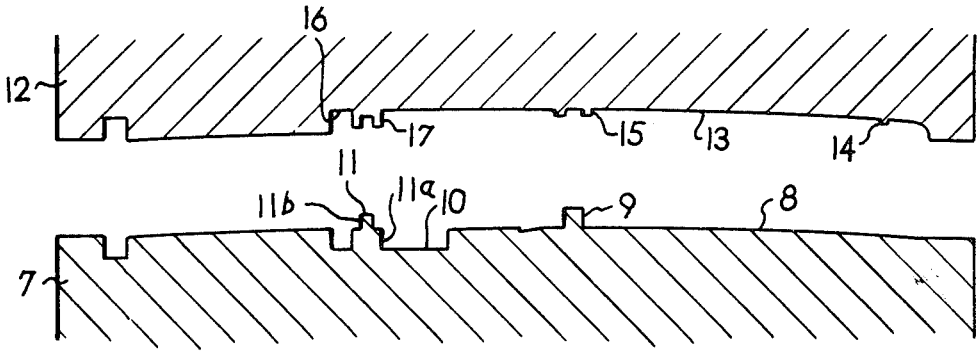
FIGS. 2*a*, 2*b* and 2*c* are a vertical cross sections showing the operation of the metal mold for injection molding.
Figure 2B:
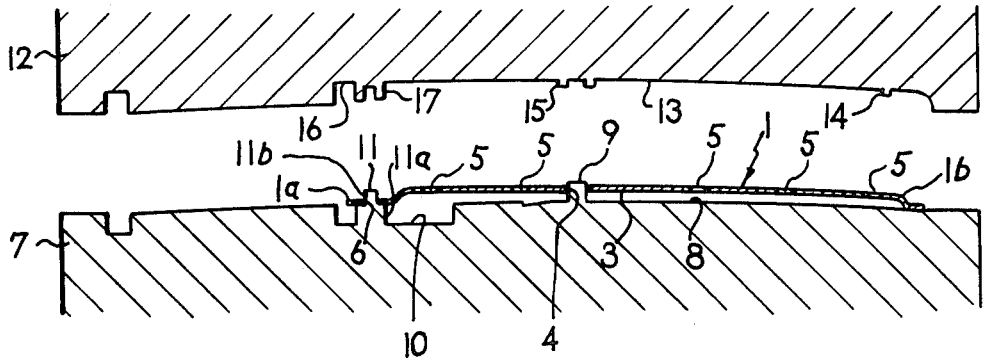
Figure 2C:
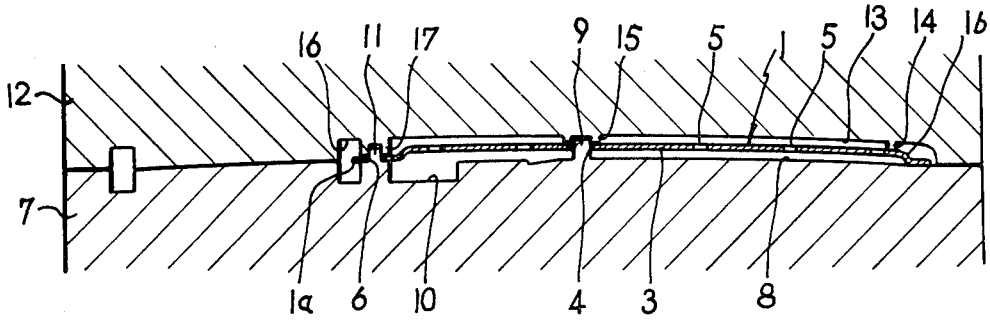

The foregoing injection molding metal mold is comprised of a male mold and a female mold as shown in FIG. 2*a*, and a blade portion forming surface 8 of the female mold 7 is formed in moderate arc-shape along the curve of the blade 1, and a pivot positioning pin 9 that loosely fits to the pivot hole 4 is provided on the blade portion forming surface 8, and a step positioning pin 11 that loosely fits to the standard hole 6 of the blade 1 is projected on a grip portion forming surface 10 of the female mold 7. This step positioning pin 11 is formed with a large diameter portion 11*a* and a small diameter portion 11*b*, and the standard hole 6 of the blade 1 is loosely fitted to the small diameter portion 11*b*. A pressure pin 14 and a cylindrical pivot pressure cylinder 15 that loosely fits with the tip of the pivot positioning pin 9 are respectively projected on a blade portion forming surface 13 of the other male mold 12, and moreover, a standard pressure cylinder 17 that fits loosely with the tip of the step positioning pin 11 (namely, tip of the small diameter portion) is projected on a grip portion forming surface 16 of the male mold 12. However, the pivot hole 4 is fitted with the pivot positioning pin 9 and the standard hole 6 is loosely fitted with the step positioning pin 11 by disposing the blade 1 with its depressed portion 3 downward so as to be arranged on the female mold 7 as shown in FIG. 2*b*, and then both male mold 7 and female mold 12 are closed as shown in FIG. 2*c*, and the blade 1 is pressurized from the bulged surface side by causing the pressure pin 14 to contact the portion closer to the tip portion of the blade 1, and the pivot pressure cylinder 15 is fitted loosely with the pivot positioning pin 9 to pressurize the blade 1 from the bulged surface side, and one surface of the blade 1 is caused to contact the blade portion forming surface 8 tightly, and the standard pressure cylinder 17 is loosely fitted with the step positioning pin 11 to allow the portion closer to the base end portion 1*a* of the blade 1 to apply pressure to the step portion of the step positioning pin 11. Molten ABS resin is injected into the cavity of both metal molds 7 and 12, and the resin forms a blade portion 18 (one side) and a grip portion 19 of the Western style scissors as shown in FIG. 3, and the resin is penetrated into the depressed portion 3 by means of the through holes 5, 5 . . . at the blade portion and is hardened.

Figure 3:
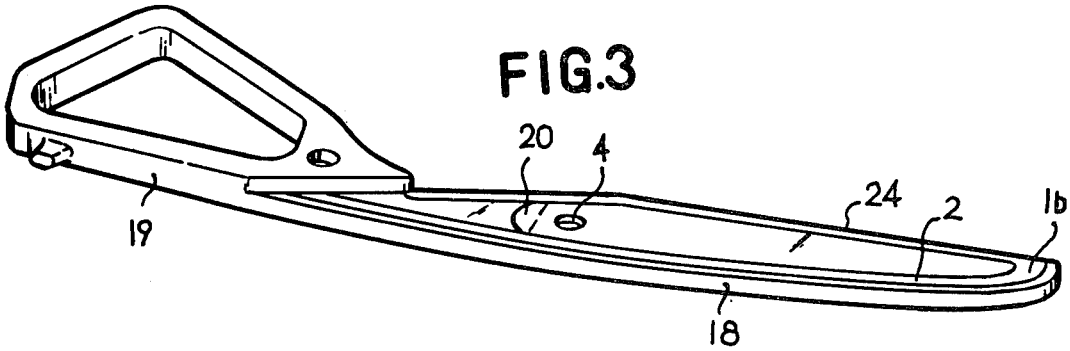
FIG. 3 is a perspective view of Western style scissors (one side)

The female mold 7 is formed in such a way that a hemispherical concave portion of about 0.2 millimeter is formed at a position closer to a base end portion in the vicinity of a pin 9 for pivot positioning, and said portion being the surface of resin which penetrates into and is hardened in the depressed portion 3, and a hemispherical projection 20 of about 0.2 millimeter height is formed in the position closer to the base end portion in the vicinity of the pivot hole 4 as shown in FIG. 3.

Figure 4:
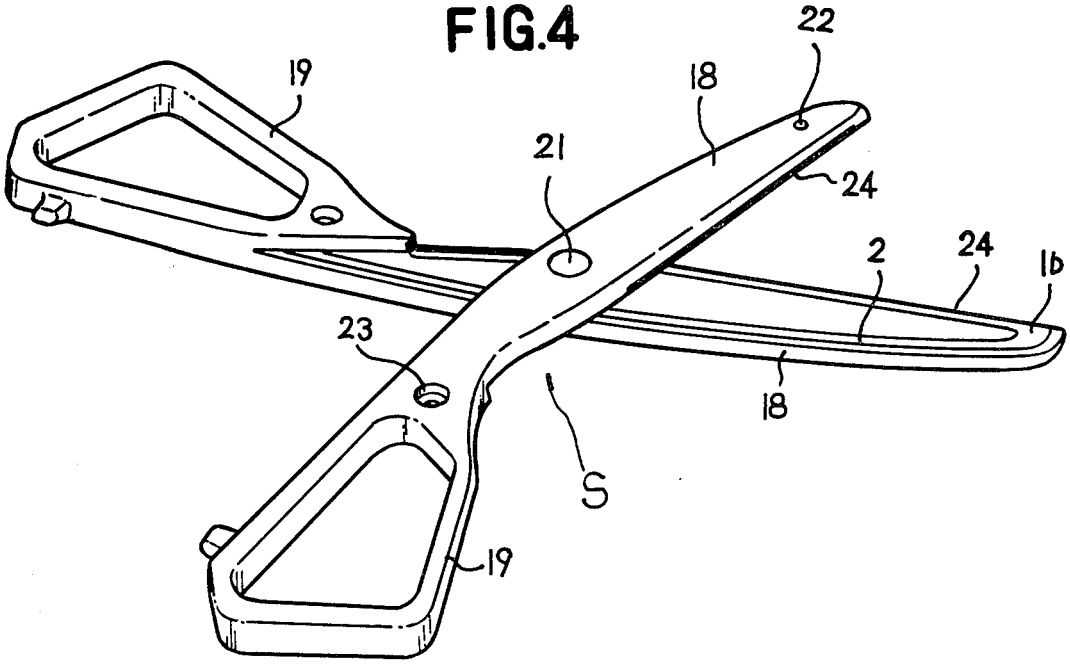
FIG. 4 is a perspective view of the assembled Western style scissors.

Accordingly, the blade 1 is positioned accurately in the female mold 7 by means of the pivot positioning pin 9 and the step positioning pin 11, and when the female mold 12 is closed, the blade 1 is pressurized by the pressure pin 14 and pivot pressure cylinder 15 and standard pressure cylinger 17, and particularly, the pressure is applied on the blade portion forming surface 8 of the male mold 7 at three points so that the resin is prevented from overflowing outside of the depressed portion 3. The molten ABS resin is injected into the cavity of both metal molds 7 and 12, and the resin forms a blade portion 18 and a grip portion 19 of the Western style scissors (one side) as shown in FIG. 3, and furthermore, at the blade portion 18, the resin penetrates into the depressed portion 3 by means of the through hole 5, 5 . . . and is hardened. Component parts of the Western style scissors produced by the foregoing manufacturing method are assembled by riveting the pivot holes as shown in FIG. 4. The sharp edge 24 of the blade 1 is appropriately exposed. In other words, according to the manufacturing method of the present invention, the embedding position of the blade 1 is accurately maintained, and the penetration of the resin is accurately performed so that there is no chance for occurrence of defective parts or product and is suitable for mass production.

What is claimed is:

1. Safety scissors that include two elongated scissor members that are pivotally joined together at a point intermediate their ends by a pivot pin so as to divide each scissor member into a gripping section and a cutting section, the improvement being that the cutting section of each scissor member is composed of a generally dish-shaped metallic member partially embedded in a plastic matrix, said generally dish-shaped metallic member consisting of an elongated and generally flat piece of metal that includes a large recessed central portion that extends on both sides of said pivot pin for substantially the full length of said cutting section and which is surrounded by a narrow outwardly extending generally oblong rim portion, one portion of said narrow rim portion serving as the sharp cutting edge for each scissor member, said large recessed central portion having a plurality of holes therein, said holes being located on both sides of said pivot pin, plastics material both filling said large recessed central portion to a level slightly below the level of said narrow rim portion and extending through said plurality of holes to the area behind said large recessed portion so as to form a sturdy support for the entire metallic member, whereby when said scissor members are moved back and forth relative to each other the only portions which come into direct sliding contact are the generally oblong narrow rim portions.

2. A method of manufacturing safety scissors that include two elongated scissor members that are pivotally joined together at a point intermediate their ends so as to divide each scissor member into a gripping section and a cutting section, the method of making each scissor member comprising the steps of:

(a) forming a blade (2) by deforming a stainless steel plate of a predetermined thickness by means of a press machine to thereby form a depressed portion (3) of predetermined depth in said blade, said depressed portion being located inwardly from the peripheral edge portions of said blade, (b) forming a plurality of through holes (5) in the depressed portion of said blade which permit the later penetration of synthetic resin, (c) forming a pivot hole (4) in the depressed portion of said blade, (d) forming a standard hole (6) in the undepressed portion of said blade that assists in accurate positioning of the blade in an injection mold, (e) preparing an injection mold that comprises a male mold (12) and a female mold (7), (f) shaping the blade portion forming surface (8) of the female mold (7) in a moderate arc shape, (g) providing said blade portion forming surface (8) of said female mold (7) with a pivot positioning pin (9) that loosely fits into said pivot hole (4) of said blade, (h) providing a gripping portion forming surface with a step positioning pin (11) for loosely fitting to the standard hole (6) of the blade, (i) causing a pressure pin 14 in the male mold 12 to press a portion close to the tip of the blade, (j) causing a pivot pressure cylinder (15) on the male mold which fits loosely with a tip of the pivot positioning pin (9), to press downardly upon the upwardly bulged surface side of the blade, (k) causing a standard pressure cylinder (17), which fits loosely with the tip of the step positioning pin (11), to press downwardly, to thereby press the blade closer to the mold, (l) positioning the blade properly in the injection mold and injecting a synthetic resin to thereby form the blade portion (18) and the grip portion (19) with the synthetic resin injected into the cavity, (m) causing the resin to penetrate into and through the depressed portion of the blade by means of the through holes (5) in the blade portion, and (n) curing the resin, and obtaining a scissor part wherein the sharp edge of the metal blade is properly exposed along the edge portion of the blade portion (18) made by the synthetic resin.

* * * * *